United States Patent [19]

Karagoz et al.

[11] Patent Number: 5,021,085

[45] Date of Patent: Jun. 4, 1991

[54] HIGH SPEED TOOL STEEL PRODUCED BY POWDER METALLURGY

[75] Inventors: Sadi Karagoz, Yildiz-Istanbul, Turkey; Bruno Hribernik, Bruck an der Mur, Austria; Johann Stamberger, Kapfenberg, Austria; Josef Puber, Wimpassing, Austria; Franz Jeglitsch, Leoben, Austria; Hellmut Fischmeister, Stuttgart 1, Austria; Franz Matzer, Leoben, Austria; Claus-Dieter Locker, Leoben, Austria; Elfriede Kudielka, Leoben, Austria; Heimo Jager, Bruck an der Mur, Austria

[73] Assignee: Boehler Ges m.b.H., Kapfenberg, Austria

[21] Appl. No.: 476,138

[22] Filed: Feb. 7, 1990

Related U.S. Application Data

[63] Continuation of Ser. No. 288,210, Dec. 22, 1988, abandoned.

[30] Foreign Application Priority Data

Dec. 23, 1987 [AU] Austria ..... A3401/87

[51] Int. Cl.[5] ..... C22C 29/02

[52] U.S. Cl. ..... 75/239; 75/245; 419/15; 419/29; 419/48; 420/10

[58] Field of Search ..... 75/239, 245; 419/15, 419/29, 48; 420/10

[56] References Cited

U.S. PATENT DOCUMENTS 4,121,929 10/1978 Kawai et al. ..... 75/238
4,121,930 10/1978 Yukawa et al. ..... 75/238
4,469,514 9/1984 Holtz ..... 75/236
4,599,109 7/1986 Kawai et al. ..... 75/238

FOREIGN PATENT DOCUMENTS 144456 8/1983 Japan .

*Primary Examiner*—Robert L. Stoll
*Assistant Examiner*—Nina Bhat
*Attorney, Agent, or Firm*—Fleit, Jacobson, Cohn, Price, Holman & Stern

[57] ABSTRACT

The invention relates to high speed tool steels produced by powder metallurgy; to parts subject to heavy wear which are fabricated from such steel; and to a method of such fabrication. According to the invention, the part subject to heavy wear contains Nb in the amount of 2–15 wt. % and V in the amount of 1–4 wt. %, and further contains metal carbides in the amount of 10–30 vol. %; and that the lower limit of the carbon content is given by the formula $$C_{min}=0.45+0.1(\%Nb)+0.20(\%V),$$

and the upper limit of the carbon content is given by the formula $$C_{max}=1.0+0.15(\%Nb)+0.24(\%V).$$

In manufacturing the steel the melt of the alloying components is subjected to atomization in an overheated state (substantially above the liquidus temperature), to produce a powder.

16 Claims, No Drawings

HIGH SPEED TOOL STEEL PRODUCED BY POWDER METALLURGY

This is a continuation of application Ser. No. 07/288,210, filed Dec. 22, 1988 which in turn is now abandoned.

BACKGROUND OF THE INVENTION

This invention relates to a high speed tool steel produced by powder metallurgy, which steel is employed for parts subject to heavy wear, particularly tools. The high speed tool steel contains C, Cr, V, W and/or Mo, possibly contains one or more of Co, Mn, Si or Al, and further contains elements which accompany iron, e.g. P, S, and O, the remainder of the composition being iron and impurities.

Such high speed tool steels are used, inter alia, as materials for manufacturing tools of the cutting type for machining applications, e.g. milling cutters, drill bits, reaming bits, or broaches; or tools of the non-cutting fabrication type, e.g. drawing dies, extrusion molding plungers, etc.

In the production of high speed tool steels alloyed with Nb, using molten metallurgical techniques, very large inclusions of niobium carbides of type MC may occur, which have grain sizes of over 100 micron. These are detrimental to the impact strength and cutting-edge wear resistance of parts subject to heavy wear fabricated from such high speed tool steels. Further, Nb is only slightly soluble in the base material of the alloys. Therefore, high speed tool steels alloyed solely with Nb generally do not have good secondary hardness properties.

The alloying element V also forms carbides of type MC. However, these have lower thermal stability than Nb carbides. Accordingly, when high hardening or austenitizing temperatures are employed, such as are required in manufacturing cutting tools in order to achieve the desired working properties, viz. hardness, the austenitic grains are undesirably increased in size, as are the deposited carbides, which results in reduced impact strength.

In attempts to alloy high speed tool steel with Nb, higher Nb contents, e.g. >1.5%, led to formation of large-grained Nb carbides, with degradation of the impact strength properties of the resulting tools, and breakingoff of parts of the cutting edges during use. A powder-metallurgical method of producing high speed tool steel is disclosed in Japanese Patent No. 144456/83, wherein the Nb concentration in the steel is limited to 0.1–1.5%, and it is represented that high W and/or Mo contents result in improved hardness following heat treatment.

The object of the instant invention is to devise high speed tool steels having thermal stability in addition to adequate wear resistance and hardness. Further, the steels should have a uniform fine distribution of carbides, in order to yield good impact strength properties, particularly at the locations of sharp cutting edges. In addition, hardness values up to 70 HRC should be attainable.

SUMMARY OF THE INVENTION

This object is attained with a powder-metallurgically produced high speed tool steel of the type described initially above, in that the steel has a Nb content of 2–15 wt. %, preferably 3–10 wt. %, optimum 4 wt. % to 10 wt. %; and a V content of 1–4 wt. %, preferably 1.5–2.5 wt. %. Furthermore, the steel has a metal carbide content of 10–30 vol. %, preferably 10–22 vol. %; and the lower limit of the C content is given by the formula $$C_{min}=0.45+0.1(\%\ Nb)+0.20(\%\ V),$$

and the upper limit of the C content is given by the formula $$C_{max}=1.0+0.15(\%\ Nb)+0.24(\%\ V).$$

A method of powder-metallurgical production of parts subject to heavy wear, particularly tools, from high speed tool steels containing C, Cr, V, W and/or Mo, possibly containing one or more of Co, Mn, Si, or Al, and further containing elements which accompany iron, e.g. P, S, and O, and the remainder of the composition comprising iron and impurities is here presented. The alloying components are melted and the melt is atomized to form powder, preferably by gas atomization, whereupon the powder is formed into a molded body in the course of a consolidation, under the influence of increased temperature and possibly pressure. This is accomplished, preferably by sintering, wherewith the molded bodies are subjected to annealing and/or hot forging, possibly followed by soft annealing, and are formed into parts subject to heavy wear by cutting-type machining or by non-cutting forming techniques. The parts are heated above their austenitizing temperature and are subjected to a high speed tool steel hardening, then are cooled from that temperature, preferably by quenching, and are subjected to at least two tempering and/or secondary hardening operations. This is characterized, according to the invention, in that a high speed tool steel alloy is employed which has a Nb content of 2–15 wt. %, preferably 3–10 wt. %, optimum 4 wt. % to 10 wt. %, and a V content of 1–4 wt. %, preferably 1.5–2.5 wt. %, and the lower limit of the C content is given by the formula $$C_{min}=0.45+0.1(\%\ Nb)+0.20(\%\ V),$$

and the upper limit of the C content is given by the formula $$C_{max}=1.0+0.15(\%\ Nb)+0.24(\%\ V);$$

furthermore, the melt of the alloying components is overheated by 100°–600° C., preferably about 300° C. above the liquidus temperature; and the thus overheated melt is atomized to form a powder.

It is advantageous according to the invention if the hardening and austenitizing process is carried out at a temperature which is 50°–100° C. higher than employed with a high speed tool steel containing no Nb or less than 2–4 wt. % Nb, and, containing the same amount of carbide as the inventive steel after the soft annealing.

The prescribed content of Nb and V, and the amount of metal carbides formed based on the prescribed range of C content in the steel, result in a high speed tool steel which has the desired advantageous properties. The atomization of the overheated melt of the alloying components to form a powder, results in a powder in which the Nb carbides formed on solidification are present in very finely distributed form, whereby they inhibit grain growth at the high austenitizing temperatures provided for according to the invention.

According to the invention, a powder-metallurgically produced part subject to heavy wear, particularly a tool, comprised of a high speed tool steel containing C, Cr, V, W and/or Mo, possibly containing one or more of Co, Mn, Si or Al, and further containing elements which accompany iron, e.g. P, S, and O, and the remainder of the composition comprising iron and impurities, is characterized in that the part subject to heavy wear has a Nb content of 2–15 wt. %, preferably 3–10 wt. %, optimum 4 wt. % to 10 wt. %; further that the part subject to heavy wear has a content of metal carbides of 10–30 vol. %, preferably 10–22 vol. %; and in that the lower limit of the C content is given by the formula $$C_{min}=0.45+0.1(\%\ Nb)+0.20(\%\ V),$$

and the upper limit of the C content is given by the formula $$C_{max}=1.0+0.15(\%\ Nb)+0.24(\%\ V).$$

The C values given in the formulas for $C_{min}$ and $C_{max}$ result ultimately from the interaction of the carbide-forming elements in the high speed tool steel, whereby the metal carbides can have different carbon concentrations. The origin of the factors in the formulas is:

NbC can bind C in the amount of 0.10–0.15 wt. %, and

VC can bind C in the amount of 0.20–0.24 wt. %.

The summands 0.45 and 1.0, respectively, in the formulas relate to the C content for forming the basic hardness of the matrix and the carbides not containing Nb or V. The $C_{min}$ and $C_{max}$ values are ultimately determined by the contents of Cr, Mo, and W.

According to another aspect of the invention, the following method is employed to produce the powder-metallurgical high speed tool steel. The individual alloying components are melted together and the melt is overheated by about 100°–600° C., preferably by 300° C., whereby the alloying components Nb and C are distributed in the melt. After holding the melt at this temperature for at least 20–30 seconds, the melt is atomized to form a powder, with the use of a protective gas. (In principle, it is also possible to employ atomization with the use of water instead of the protective gas). The rapid cooling causes small, finely divided Nb carbides to precipitate out. The powders are then used to produce molded parts, using increased temperature and (possibly) pressure. For this purpose, the powder is charged into steel containers comprised of alloy steel or non-alloy steel, the containers are hermetically sealed, and the powder is consolidated at increased pressure and temperature, e.g. by hiping (hot isostatic pressing), extruding, or forging. An important consideration in the consolidation is to select a temperature at which no liquid phases occur. The temperatures in the consolidation are about 1050°–1100° C. at a pressure of 1000 bar, or about 1200°–1250° C. at atmospheric pressure.

By a subsequent hot forming, e.g. hot forging at 1150° C., one can increase the strength, e.g. the bending strength, of the molded part. Such a hot forming operation, if carried out, is preceded by a soft annealing at about 700°–850° C., preferably 800° C. The soft-annealed workpiece is then formed into the desired part subject to heavy wear (e.g. tool) by a cutting machining operation or by a non-cutting forming operation. After the tool body is produced, the workpiece is hardened, using an austenitizing temperature of up to 1350° C. During this hardening process, the Nb carbide inhibits grain growth, and the undissolved vanadium carbide contributes to formation of a very fine grain structure prior to the quenching in air, water, or oil. The higher austenitizing temperature provided according to the invention enables more of the carbide which is present at this temperature to break down and/or go into solution, so that the grain structure occurring in the matrix after the subsequent cooling is fine and hard. After the quenching, a first annealing is carried out at about 500°–600° C., during which fine metal carbides (e.g., vanadium carbide of type MC) separate out. The hardness properties of the workpiece can be further improved by a second or third, etc., annealing.

The higher austenitizing temperature can be employed without suffering changes which reduce impact strength, undue grain growth, [intergranular] fusion, and other detrimental changes. Because chromium influences the deposition of carbides, the content of Cr is limited to the range 2–5 wt. %. Any Co present should be in the range of 0–10 wt. %.

In the steels and workpieces produced according to this invention the metal carbides have a particular size less than 6 micron. By increasing the melt temperature and the solidification speed in the course of manufacturing the metal powder, further reduction of the particle size of the included metal carbides is possible.

DETAILED DESCRIPTION OF THE INVENTION

The invention will be described in more detail below, with reference to exemplary embodiments.

Example 1

A high speed tool steel alloy of the following composition (in units of wt. %) (based on analysis of the workpiece)

| | | | |
|---|---|---|---|
| C | 1.81 | Si | 0.3 |
| Mn | 0.2 | P | 0.02 |
| S | 0.02 | Cr | 4.3 |
| Mo | 3.7 | V | 1.5 |
| W | 6.1 | Nb | 6.3 |
| Fe and impurities (remainder) | | | |

was melted in an induction furnace and cast to form an ingot, which was then melted, and the melt was overheated by 300° C. and was atomized in a nitrogen stream to form a powder. The powder was charged into a capsule comprised of St52 structural steel, the capsule was vibrated, the pressure was reduced to 0.001 torr, and the capsule was welded hermetically shut. Consolidation of the powder was carried out at 1150° C. and 1070 bar. A milling tool was fabricated, and hardening (austenitizing) was carried out at 1290° C. without major increase in grain size or fusion at the grain boundaries. Using this austenitizing temperature, which was about 50° C. above the customary hardening temperature, it was possible to dissolve more carbides (and carbon) in the matrix, whereby the hardness and wear resistance were improved in the annealing processes.

Measured hardness was 68.8 HRC. In a cutting (wear) test the inventively manufactured milling tools had a productivity which was greater by 30–50% than than of milling tools comprised of S6-5-2-5 alloy, when used for milling St52 structural steel or type X38CrMoV51 heat-treatable steel.

Example 2

A high speed tool alloy of the following composition (in units of wt. %)

| | | | |
|---|---|---|---|
| C | 2.49 | Si | 0.35 |
| Mn | 0.20 | P | 0.025 |
| S | 0.005 | Cr | 4.7 |
| Mo | 4.01 | V | 2.3 |
| W | 1.82 | Nb | 9.89 |
| Fe and impurities (remainder) | | | |

was melted and was cast to form an ingot, which was then atomized (in a protective medium) at a temperature 350° C. above the liquidus temperature, to form a powder. A shaving wheel (similar to a reamer), such as used for fine machining of gear wheels in the automobile industry, was fabricated from the powder, using a sintering technique. The wheel was hardened at an austenitizing temperature of 1300° C., followed by two annealings at 580° C. Then the wheel was final-machined by grinding. In the working region of the tool, the measured hardness was 69.5 HRC.

In the fabrication of external spur gears, the inventive shaving tool had a productivity which was greater by 40–50% than that of a shaving tool, comparably manufactured by powder metallurgy from S6-5-3-8 (ASP 30) high speed tool steel, when used for fabricating external spur gear wheels.

What is claimed is:

1. A high speed tool steel produced by powder metallurgy, which is suitable for use in parts that are subject to heavy wear, particularly tools, wherein said high speed tool steel has a Nb content of 2–15% by weight, a V content of 1–4% by weight, a metal carbide content of 10–30% by volume, and wherein the lower limit of the C content is given by the formula:

$$C_{min}=0.45+0.1(\%\ Nb)+0.20(\%\ V),$$

and the upper limit of the C content is given by the formula:

$$C_{max}=1.0+0.15(\%\ Nb)+0.24(\%\ V).$$

2. The high speed tool steel of claim 1 wherein the Nb content is 3–10 wt. %, the V content is 1.5–2.5 wt. %, and the content of metal carbides is 10–22 vol. %.

3. The high speed tool steel as claimed in claim 2 wherein the Nb content is 4–10 wt. %.

4. A method for the powder-metallurgical production of parts subject to heavy wear, particularly tools, from high speed tool steels, wherein said high speed tool steel has a Nb content of 2–15% by weight, a V content of 1–4% by weight, a metal carbide content of 10–30% by volume and wherein the lower limit of the C content is given by the formula:

$$C_{min}=0.45+0.1(\%\ Nb)+0.20(\%\ V),$$

and the upper limit of the C content is given by the formula:

$$C_{max}=1.0+0.15(\%\ Nb)+0.24(\%\ V),$$

said method comprising the steps of:

(a) melting the alloying components of the steel to form a melt of the alloying components;

(b) overheating said melt to 100°–600° C., above the liquidus temperature of said melt, and atomizing said melt, whereby a powder is formed;

(c) forming molded bodies from said powders by consolidating said powders at a temperature and pressure such that no liquid phase occurs;

(d) forming parts from said molded bodies;

(e) hardening said parts by heating said parts at an austenitizing temperature of up to 1350° C.

5. The method of claim 1 wherein the Nb content is 3–10 wt. % and the V content is 1.5–2.5 wt. %; and the alloying components are overheated about 300° C. above the liquidus temperature.

6. The method of claim 5 wherein the Nb content is 4–10 wt. %.

7. The method of claim 4 wherein the hardening and austenitizing process is carried out at a temperature which is 50°–100° C. higher than employed with a high speed tool steel containing no Nb or less than 2–4 wt. % Nb, and the same amount of carbides as the inventive steel after the soft annealing; wherewith, said hardening and austenitizing temperature is selected from between 1100° C. and 1260° C., depending on the composition.

8. The method of claim 7, wherein between steps (c) and (d) said molded bodies are soft annealed at from 700°–850° C.

9. The method of claim 8 wherein the soft annealing temperature is about 800° C.

10. The method of claim 4 wherein the hardening and austenitizing temperature is up to 1350° C.

11. The method of claim 4 wherein the hardening and austenitizing temperature is up to 1290° C.

12. The method of claim 4 wherein there is a soft annealing step and during the soft annealing a content of 10–30 vol. % of metal carbides is established in the molded piece.

13. The method of claim 12 wherein the content of the metal carbides is 10–22 vol. %.

14. A tool comprising the high speed tool steel of claim 1.

15. The method of claim 4, further comprising cooling said parts and subjecting said cooled parts to at least one annealing step at about 500°–600° C.

16. A tool produced by the method of claim 4.

* * * * *